US009161668B2

(12) United States Patent
Quance et al.

(10) Patent No.: US 9,161,668 B2
(45) Date of Patent: Oct. 20, 2015

(54) FILTER ASSEMBLY FOR A VACUUM CLEANING APPLIANCE

(75) Inventors: Miles Sinclair Quance, Malmesbury (GB); Stephen Farrar Smith, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 508 days.

(21) Appl. No.: 13/240,778

(22) Filed: Sep. 22, 2011

(65) Prior Publication Data

US 2012/0073078 A1 Mar. 29, 2012

(30) Foreign Application Priority Data

Sep. 23, 2010 (GB) ..... 1015948.1

(51) Int. Cl.
*A47L 9/16* (2006.01)
*A47L 9/12* (2006.01)

(52) U.S. Cl.
CPC ..... *A47L 9/1666* (2013.01); *A47L 9/127* (2013.01)

(58) Field of Classification Search
CPC ..... A47L 9/127; A47L 9/166; A47L 9/1666
USPC ..... 15/347, 353, 327.6, 327.115, 411
See application file for complete search history.

(56) References Cited

U.S. PATENT DOCUMENTS 5,205,014 A * 4/1993 Yoo ..... 15/353
5,388,301 A * 2/1995 Bosyj et al. ..... 15/327.1
6,818,032 B2 * 11/2004 Bilek et al. ..... 55/337
7,335,241 B2 * 2/2008 Oh et al. ..... 55/343
7,360,275 B2 * 4/2008 Allgeier et al. ..... 15/347
7,922,794 B2 * 4/2011 Morphey ..... 95/271
8,051,532 B1 * 11/2011 Griffith et al. ..... 15/353
8,152,877 B2 * 4/2012 Greene ..... 55/337
8,152,878 B2 * 4/2012 McLeod ..... 55/343
8,375,509 B2 * 2/2013 Bates et al. ..... 15/353

(Continued)

FOREIGN PATENT DOCUMENTS

CN 2764289 3/2006
DE 103 47 454 9/2004

(Continued)

OTHER PUBLICATIONS

International Search Report and Written Opinion mailed Nov. 16, 2011, directed to International Application No. PCT/GB2011/051570; 13 pages.

(Continued)

*Primary Examiner* — Monica Carter
*Assistant Examiner* — Michael Jennings
(74) *Attorney, Agent, or Firm* — Morrison & Foerster LLP

(57) ABSTRACT

A vacuum cleaning appliance includes a filter housing having at least one air inlet for receiving an air flow, a filter assembly removably locatable within the filter housing for removing dirt from the air flow, and a duct for receiving the air flow exhausted from the filter assembly. The filter assembly includes a filter body, a filter mounted on the filter body, and a spring-loaded coupling member moveable relative to the filter body for engaging the duct. The coupling member includes an air outlet through which the air flow is exhausted from the filter assembly. A convoluted sealing member forms a seal between the filter body and the coupling member while allowing relative movement therebetween as the coupling member engages the duct.

29 Claims, 12 Drawing Sheets

(56) References Cited

U.S. PATENT DOCUMENTS

| | | | | |
|---|---|---|---|---|
| 8,402,599 | B2 * | 3/2013 | Charlton et al. | 15/352 |
| 8,409,335 | B2 * | 4/2013 | Dyson et al. | 96/55 |
| 8,424,153 | B2 * | 4/2013 | Fester et al. | 15/347 |
| 8,434,193 | B2 * | 5/2013 | Sunderland et al. | 15/353 |
| 8,435,318 | B2 * | 5/2013 | Lee et al. | 55/429 |
| 8,474,091 | B2 * | 7/2013 | Dyson et al. | 15/327.2 |
| 2007/0017064 | A1 | 1/2007 | Gogel et al. | |
| 2010/0242208 | A1 * | 9/2010 | Gammack et al. | 15/327.1 |
| 2010/0242212 | A1 * | 9/2010 | Dyson et al. | 15/347 |
| 2010/0242213 | A1 * | 9/2010 | Sunderland et al. | 15/347 |
| 2010/0242214 | A1 * | 9/2010 | Sunderland et al. | 15/347 |
| 2010/0242216 | A1 * | 9/2010 | MacNaughton | 15/347 |
| 2010/0242217 | A1 * | 9/2010 | Sunderland et al. | 15/347 |
| 2010/0242219 | A1 * | 9/2010 | Dyson et al. | 15/347 |
| 2010/0242221 | A1 * | 9/2010 | Horne et al. | 15/347 |

FOREIGN PATENT DOCUMENTS

| | | |
|---|---|---|
| EP | 0 836 827 | 4/1998 |
| EP | 1 669 015 | 6/2006 |
| GB | 2469046 | 10/2010 |
| WO | WO-03/068042 | 8/2003 |
| WO | WO-2010/112883 | 10/2010 |
| WO | WO-2010/112887 | 10/2010 |

OTHER PUBLICATIONS

Search Report dated Jan. 24, 2011, directed to GB Application No. 1015948.1; 1 page.

GB Search Report dated Jan. 24, 2011, directed to counterpart GB Application No. 1015948.1; 1 page.

* cited by examiner

A - A

FILTER ASSEMBLY FOR A VACUUM CLEANING APPLIANCE

REFERENCE TO RELATED APPLICATIONS

This application claims the priority of United Kingdom Application No. 1015948.1, filed Sep. 23, 2010, the entire contents of which are incorporated herein by reference.

FIELD OF THE INVENTION

The present invention relates to a filter assembly for a vacuum cleaning appliance, and to a vacuum cleaning appliance including a filter assembly.

BACKGROUND OF THE INVENTION

Cleaning appliances such as vacuum cleaners are well known. The majority of vacuum cleaners are either of the "upright" type or of the "cylinder" type (called canister or barrel machines in some countries). Cylinder vacuum cleaners generally comprise a main body which contains a motor-driven fan unit for drawing a dirt-bearing air flow into the vacuum cleaner, and separating apparatus, such as a cyclonic separator or a bag, for separating dirt and dust from the air flow. The dirt-bearing air flow is introduced to the main body through a suction hose and wand assembly which is connected to the main body. The main body of the vacuum cleaner is dragged along by the hose as a user moves around a room. A cleaning tool is attached to the remote end of the hose and wand assembly.

For example, WO 03/068042 describes a cylinder vacuum cleaner having a chassis which supports cyclonic separating apparatus. The vacuum cleaner has two main wheels, one on each side of a rear portion of the chassis, and a castor wheel located beneath the front portion of the chassis which allow the vacuum cleaner to be dragged across a surface. Such a castor wheel tends be mounted on a circular support which is, in turn, rotatably mounted on the chassis to allow the castor wheel to swivel in response to a change in the direction in which the vacuum cleaner is dragged over the surface. The separating apparatus comprises an air inlet through which air can enter the separating apparatus in a tangential manner, and an air outlet which is located on a rear wall of the separating apparatus for conveying air to a fan unit for drawing an air flow through the vacuum cleaner.

PCT/GB2010/050418 describes a cylinder vacuum cleaner having a generally spherical rolling assembly connected to the chassis for improving the maneuverability of the vacuum cleaner over a floor surface. The rolling assembly comprises a body and a pair of dome shaped wheels connected to the body. The chassis extends forwardly from the body of the rolling assembly, and includes a pair of wheels for steering the vacuum cleaner and for supporting the rolling assembly as the vacuum cleaner is maneuvered over a floor surface. The chassis also includes a support for supporting cyclonic separating apparatus of the vacuum cleaner. The separating apparatus includes two cyclonic separating stages and a filter assembly located downstream from the cyclonic separating stages.

A fan unit for drawing an air flow through the vacuum cleaner is located within the rolling assembly. Air is conveyed from the separating apparatus to the rolling assembly by a duct which extends from an upper surface of the separating apparatus to an upper surface of the body of the rolling assembly. The support for supporting the separating apparatus is biased so as to urge the separating apparatus upwardly towards the duct so that an air outlet of the filter assembly is urged against the air inlet of the duct to maintain an air-tight seal therebetween.

The inventors have found that depending on the size of the separating apparatus, the variation in the weight of the separating apparatus between a loaded state, in which the separating apparatus is filled with dirt and other detritus separated from the air flow, and an unloaded state can be relatively large. When the separating apparatus has a relatively large volume, a relatively high spring force may be required to maintain the air tight seal between the separating apparatus and the duct over the loading range of the separating apparatus. This can in turn result in the separating apparatus applying an undesirably high force to the duct when it is in its unloaded state, which over a prolonged period of time could result in damage to the duct or the separating apparatus, or to any seals made between the separating apparatus and the duct.

SUMMARY OF THE INVENTION

In a first aspect the present invention provides a vacuum cleaning appliance comprising a filter housing having at least one air inlet for receiving an air flow, a filter assembly removably locatable within the filter housing for removing dirt from the air flow, and a duct for receiving the air flow exhausted from the filter assembly, wherein the filter assembly comprises a filter body, a filter mounted on the filter body, a biased, or spring-loaded, coupling member moveable relative to the filter body for engaging the duct, the coupling member comprising an air outlet through which the air flow is exhausted from the filter assembly, and a sealing member for forming a seal between the filter body and the coupling member.

The present invention thus maintains an air tight seal between the filter assembly and the duct by biasing only a portion of the filter assembly, namely a coupling member including the air outlet from the filter assembly, towards the duct. The magnitude of the biasing force required to urge the coupling member towards the duct can therefore have a relatively low and relatively constant value, as the load acting on a resilient element or other means for urging the coupling member towards the duct is not affected by the weight of the dirt separated from the air flow by the filter or other separating apparatus of the cleaning appliance.

The provision of a sealing member between the filter body and the coupling member prevents air from leaking between the filter body and the coupling member. The sealing member is preferably in the form of a convoluted sealing member to allow the seal to be maintained between the filter body and the coupling member over the full range of the movement of the coupling member relative to the filter body under the action of the resilient member. Preferably, one end of the convoluted sealing member is connected to the coupling member, and the other end of the convoluted sealing member is connected to the filter body.

The filter assembly preferably comprises a sealing element for engaging the filter housing to prevent air from leaking between the filter assembly and the filter housing. The sealing element preferably comprises an annular sealing element, which is preferably in the form of a lip seal. To reduce the number of components of the filter assembly, the annular sealing element is preferably connected to, and more preferably integral with, the sealing member.

The coupling member is generally cup-shaped, comprising a base and a side wall extending upwardly from the base. The base preferably comprises at least one aperture. The side wall preferably has a concave inner surface for engaging the duct of the vacuum cleaning appliance. The duct preferably comprises an annular resilient sealing member for engaging the concave surface of the coupling member of the filter assembly to form a seal between the filter assembly and the duct. This can permit a degree of relative rotational movement between the filter assembly and the duct while maintaining an air tight seal therebetween.

The filter body and the coupling member are preferably arranged so that the coupling member moves relative to the filter body along the longitudinal axis of the filter body. The longitudinal axis of the coupling member is preferably colinear with the longitudinal axis of the filter body.

A resilient element for urging the coupling member away from the filter body is preferably located between the filter body and the coupling member. The resilient element is preferably aligned with the longitudinal axis of the coupling member. In a preferred embodiment, each of the filter body and the coupling member comprises a central hub, and the resilient element is located between the hubs to urge the coupling member away from the filter body.

The hub of the coupling member preferably extends upwardly from the base of the coupling member so as to be surrounded by, and spaced from, the concave surface of the coupling member. Each of the hubs is preferably supported by a plurality of spokes extending radially outwardly from the hub. To reduce the size of the filter assembly, the spokes of the coupling member preferably mesh with the spokes of the filter body when the coupling member is urged towards the filter body, against the biasing force of the resilient element, when the coupling member engages the duct.

The filter may be of any shape in cross section, for example it may be round, square or triangular in cross section. The filter may be deformable. For example the filter may be formed from a soft foldable material or fabric. Alternatively, the filter may be formed from any suitable material for example glass, fleece, polyester, polypropylene, polyurethane, polytetrafluoroethylene or any other suitable plastics material. The filter medium may be an open cell reticulated plastics foam, for example a polyurethane foam. The polyurethane foam may be derived from either polyester or polyether. As another alternative, the filter may be an electrostatic filter. For example, the filter may be in the form of a frictional electrostatic filter, an electret media filter or an electrostatic filter connected to a high voltage power supply. The filter may be formed from a plurality of layers of filter medium which may be glued, bonded or stitched together in any suitable way.

In a preferred embodiment the filter is in the form of a sock filter. As used herein the term "sock filter" shall be taken to mean that the filter is generally tubular with a closed lower end. The filter body is preferably generally tubular in shape, and comprises a bore along which the air flow passes to the air outlet of the coupling member. The filter housing preferably comprises an annular seat for supporting the filter body of the filter assembly. The filter preferably extends about the filter body, and so the filter body preferably comprises a filter frame extending about the bore, and about which the filter is located. The frame preferably extends away from the coupling member, and about the longitudinal axis of the filter body. Where the filter is in the form of a sock filter, the filter preferably extends about the frame of the filter body. The open end of the filter is preferably connected to the filter body, for example by a snap fit or a threaded connection.

With this configuration of the filter assembly, the air flow enters the filter assembly through the filter of the filter assembly. As mentioned above, the filter is preferably in the form of a sleeve or sock filter surrounding a frame of the filter body. The air flow passes sequentially through the filter and the filter frame, and enters the bore of the filter body. The filter frame thus serves to prevent the filter from collapsing as the air flow passes through the filter. The air flow subsequently passes axially along the bore of the filter body, and between the spokes of the filter body and the coupling member to be exhausted from the filter assembly.

The duct is preferably moveable relative to the housing to allow the filter assembly to be removed from the filter housing. Preferably, a portion of the filter assembly is manually accessible by a user when the duct is moved away from the filter assembly to allow the user to remove the filter assembly from the filter housing. For example, a lug, tab or tag may be connected to or integral with the coupling member of the filter assembly to allow the user to pull the filter assembly from the filter housing. In a preferred embodiment, the hub of the coupling member is gripped by the user to remove the filter assembly from the filter housing. The hub preferably extends along the longitudinal axis of the coupling member away from the base of the coupling member, and may protrude outwardly therefrom to facilitate gripping of the hub by the user. When the duct is connected to the filter assembly, at least part of the hub may be surrounded by the duct.

The appliance preferably comprises a motor-driven fan unit for drawing the air flow through the appliance. The filter assembly is preferably located upstream from the fan unit, in which case the duct is arranged to convey the air flow exhausted from the filter assembly towards the fan unit. Alternatively, the filter assembly may be located downstream from the fan unit, in which case the duct is arranged to convey the air flow exhausted from the filter assembly to an air outlet of the appliance.

In addition to the filter assembly, the vacuum cleaning appliance may also comprise cyclonic separating apparatus for separating dirt from the air flow upstream of the filter assembly. Where the filter assembly is located upstream from the fan unit, the filter housing may be conveniently located in the separating apparatus. The cyclonic separating apparatus preferably comprises a plurality of cyclonic separating stages, and the filter housing is preferably located downstream from the cyclonic separating stages. For example, the cyclonic separating apparatus may comprise a plurality of cyclones arranged in parallel upstream from the filter housing, and the filter housing may comprise a plurality of air inlets each for receiving a portion of the air flow from a respective one of the cyclones. For a compact arrangement the cyclones preferably surround the filter housing. An opening of the filter housing, through which the filter assembly is inserted into and removed from the filter housing, is preferably located in an upper surface of the separating apparatus.

The separating apparatus is preferably removable from the appliance to allow collected dirt to be discharged from the separating apparatus. The engagement between the duct and the filter assembly may serve, at least in part, to retain the separating apparatus on the appliance, and so the duct is preferably moveable relative to the separating apparatus to allow the separating apparatus to be removed from the appliance.

The cleaning appliance may comprise a floor engaging rolling assembly comprising an air inlet for receiving the air flow from the duct, and means for acting on the air flow received through its air inlet. The rolling assembly is preferably substantially spherical. The rolling assembly may comprise a substantially spherical casing which rotates as the cleaning appliance is moved over a floor surface. However, the appliance preferably comprises a main body and a plurality of floor engaging rolling elements rotatably connected to the main body, and which may together define a substantially spherical floor engaging rolling assembly. The means for acting on the air flow preferably comprises means for drawing the air flow through the separating apparatus, and is preferably connected to the main body so that it does not rotate as the cleaning appliance is moved over the floor surface. The means for drawing the air flow through the separating apparatus preferably comprises a motor driven fan unit. Alternatively, or additionally, the means for acting on the air flow may comprise a filter for removing particulates from the air flow passing through the rolling assembly. The filter preferably extends about the motor, and is preferably removable from the main body. For example, the filter may be accessed by removing part of the outer casing of the main body of the rolling assembly, or by disconnecting one of the rolling elements from the main body.

Each of the plurality of rolling elements is preferably in the form of a wheel rotatably connected to a respective side of the main body of the rolling assembly. Each of these rolling elements preferably has a curved, preferably dome-shaped, outer surface. The rotational axes of the rolling elements may be inclined upwardly towards the main body with respect to a floor surface upon which the cleaning appliance is located so that the rims of the rolling elements engage the floor surface. The angle of the inclination of the rotational axes is preferably in the range from 4 to 15°, more preferably in the range from 5 to 10°. As a result of the inclination of the rotational axes of the rolling elements, part of the outer surface of the main body is exposed to enable components of the cleaning appliance, such as user-operable switches for activating the motor or a cable-rewind mechanism, to be located on the exposed part of the main body. In a preferred embodiment, one or more ports for exhausting the air flow from the cleaning appliance are located on the outer surface of the main body.

To facilitate the detachment of the duct from the filter assembly, the duct is preferably pivotably connected to the rolling assembly, more preferably to the main body of the rolling assembly. The duct is preferably connected to the upper surface of the rolling assembly so that it can be moved between a raised position to allow the separating apparatus to be removed from, and subsequently relocated on, the appliance, and a lowered position, in which the duct is coupled to the coupling member. The duct is preferably formed from a rigid material, preferably a plastics material, and may include a handle. The appliance preferably comprises means for releasably retaining the duct in the lowered position. This can inhibit accidental detachment of the duct from the separating apparatus during use of the appliance, and also allows the appliance to be carried using the handle of the duct.

As mentioned above, the filter assembly is removable from the filter housing of the vacuum cleaning appliance, and so may be sold separately, for example as a spare part.

In a second aspect the present invention provides a filter assembly for a vacuum cleaning appliance, the filter assembly comprising a filter body, a filter mounted on the filter body, a biased coupling member moveable relative to the filter body for coupling the filter assembly to a duct of the vacuum cleaning appliance for receiving an air flow exhausted from the filter assembly, the coupling member comprising an air outlet through which the air flow is exhausted from the filter assembly, and a sealing member for forming a seal between the filter body and the coupling member.

Features described above in connection with the first aspect of the invention are equally applicable to the second aspect of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
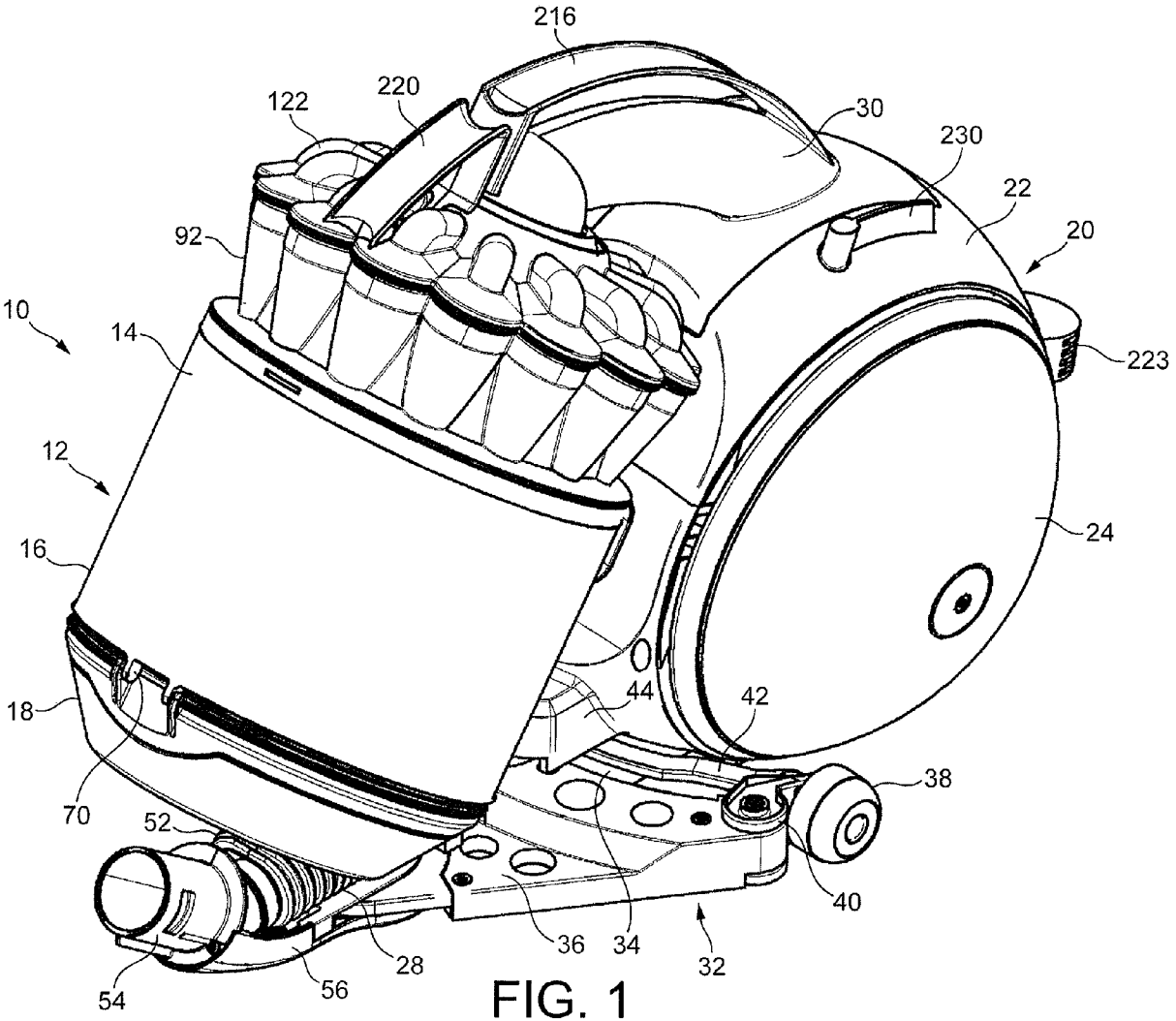
FIG. 1 is a front perspective view, from above, of a vacuum cleaner.
Figure 2A:
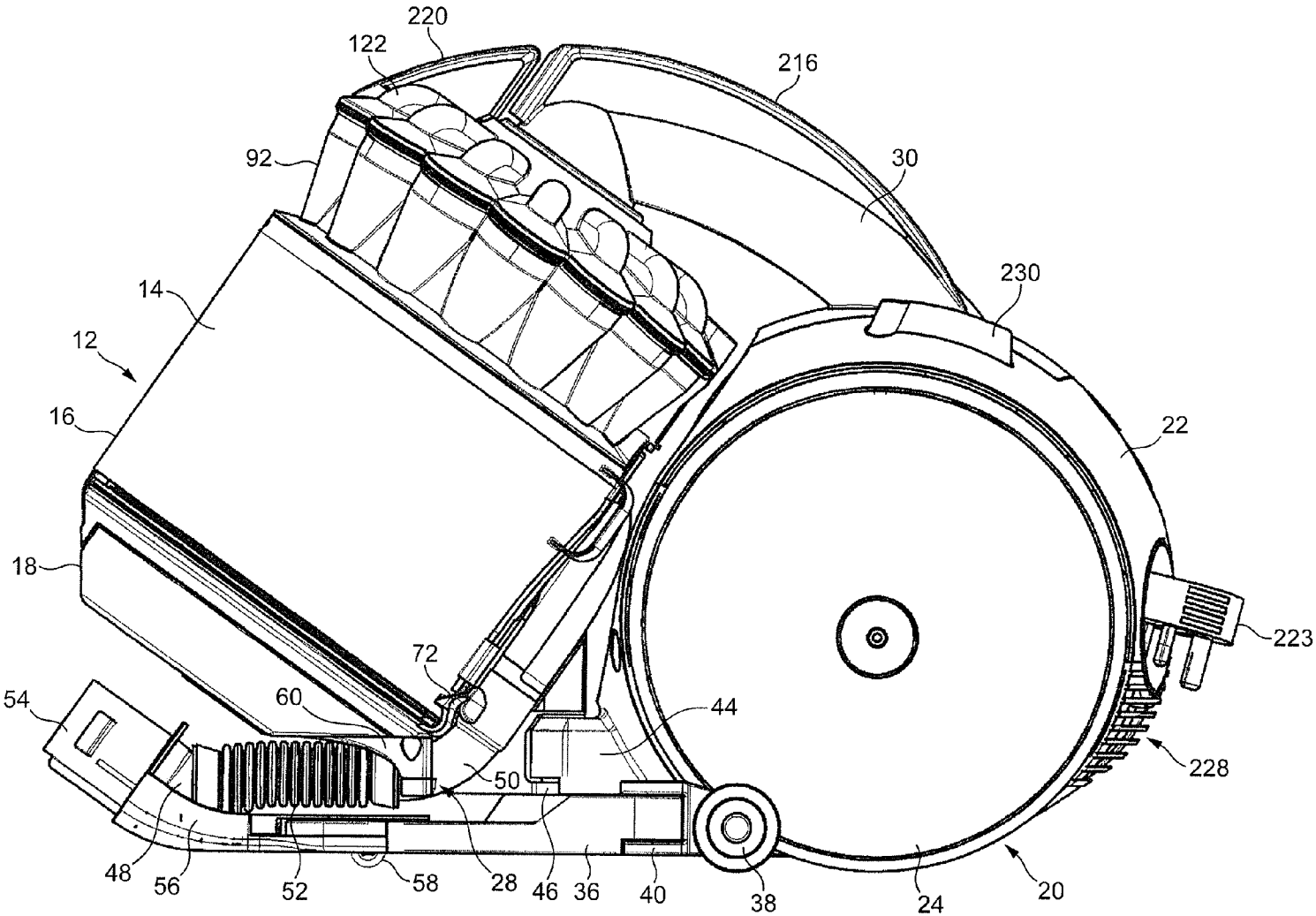
FIG. 2(*a*) is a side view of the vacuum cleaner, with a duct of the vacuum cleaner in a lowered position, and FIG. 2(*b*) is a side view of the vacuum cleaner with the duct in a raised position.
Figure 2B:
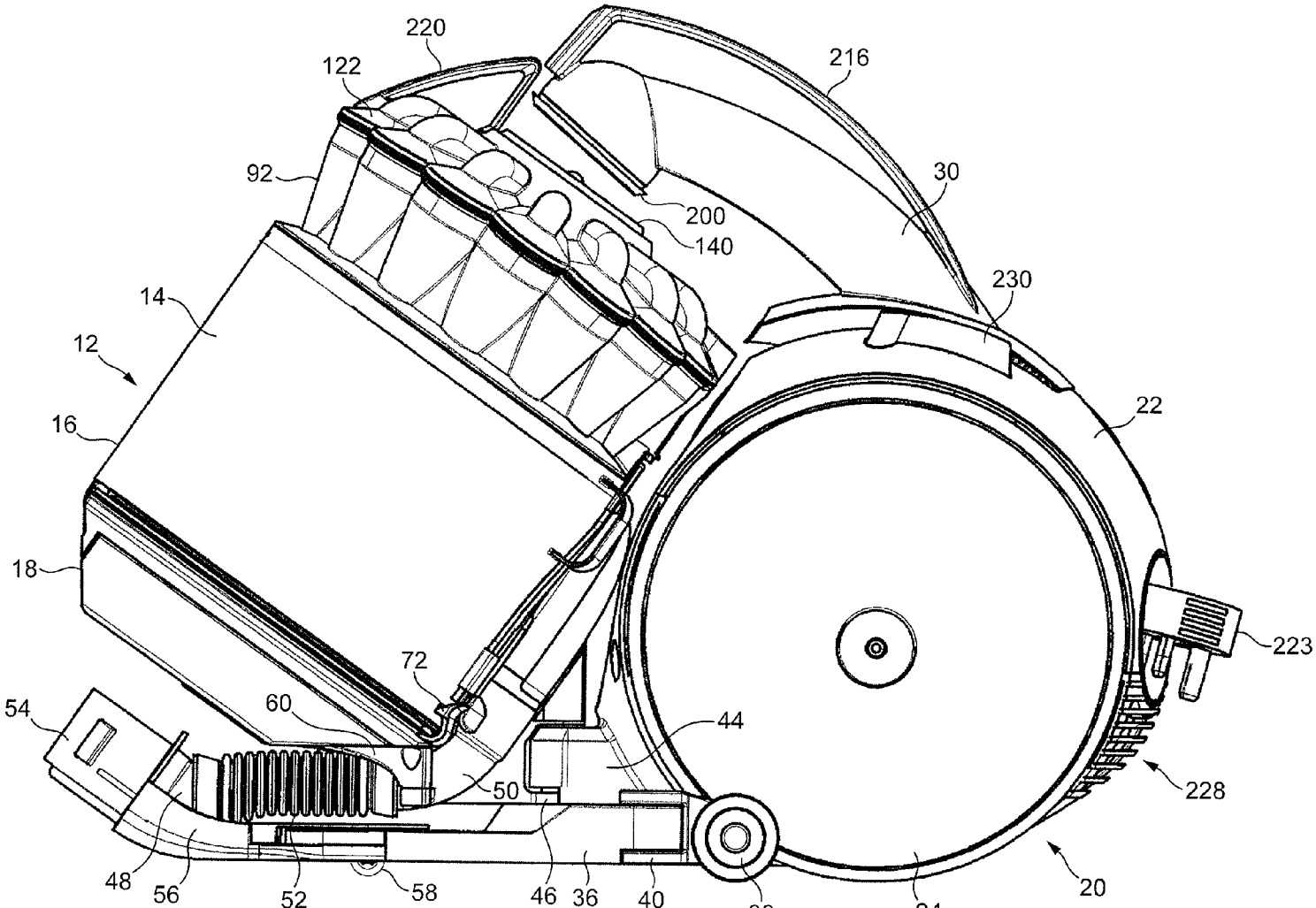

FIGS. 1 and 2(*a*) illustrate external views of a cleaning appliance in the form of a vacuum cleaner 10. The vacuum cleaner 10 is of the cylinder, or canister, type. In overview, the vacuum cleaner 10 comprises separating apparatus 12 for separating dirt and dust from an air flow. The separating apparatus 12 is preferably in the form of cyclonic separating apparatus, and comprises an outer bin 14 having an outer wall 16 which is substantially cylindrical in shape. The lower end of the outer bin 14 is closed by curved base 18 which is pivotably attached to the outer wall 16. A motor-driven fan unit for generating suction for drawing dirt laden air into the separating apparatus 12 is housed within a rolling assembly 20 located behind the separating apparatus 12. The rolling assembly 20 comprises a main body 22 and two wheels 24, 26 rotatably connected to the main body 22 for engaging a floor surface. An inlet duct 28 located beneath the separating apparatus 12 conveys dirt-bearing air into the separating apparatus 12, and an outlet duct 30 conveys air exhausted from the separating apparatus 12 into the rolling assembly 20.

A chassis 32 is connected to the main body 22 of the rolling assembly 20. The chassis 32 is generally in the shape of an arrow, and comprises a shaft 34 connected at the rear end thereof to the main body 22 of the rolling assembly 20, and a generally triangular head 36. The inclination of the side walls of the head 36 of the chassis 32 can assist in maneuvering the vacuum cleaner 10 around corners, furniture or other items upstanding from the floor surface, as upon contact with such an item these side walls tend to slide against the upstanding item to guide the rolling assembly 20 around the upstanding item.

A pair of wheel assemblies 38 for engaging the floor surface is connected to the head 36 of the chassis 32. Each wheel assembly 38 is connected to a respective corner of the head 36 by a steering arm 40 shaped so that the wheel assemblies 38 are located behind the head 36 of the chassis 32, but contact a floor surface in front of the wheels 24, 26 of the rolling assembly 20. The wheel assemblies 38 thus support the rolling assembly 20 as it is maneuvered over a floor surface, restricting rotation of the rolling assembly 20 about an axis which is orthogonal to the rotational axes of the wheel assemblies 38, and substantially parallel to the floor surface over which the vacuum cleaner 10 is being maneuvered. The distance between the points of contact of the wheel assemblies 38 with the floor surface is greater than that between the points of contact of the wheels 24, 26 of the rolling assembly 20 with that floor surface. In this example, each steering arm 40 is connected at a first end thereof to the chassis 32 for pivoting movement about a respective hub axis. Each hub axis is substantially orthogonal to the axes of rotation of the wheel assemblies 38. The second end of each steering arm 40 is connected to a respective wheel assembly 38 so that the wheel assembly 38 is free to rotate as the vacuum cleaner 10 is moved over the floor surface.

The movement of the steering arms 40, and thus the wheel assemblies 38, relative to the chassis 32 is controlled by an elongate track control arm 42. Each end of the track control arm 42 is connected to the second end of a respective steering arm 40 so that movement of the track control arm 42 relative to the chassis 32 causes each steering arm 40 to pivot about its hub axis H. This in turn causes each wheel assembly 38 to orbit about its respective corner of the chassis 32 to change the direction of the movement of the vacuum cleaner 10 over the floor surface.

Figure 3:
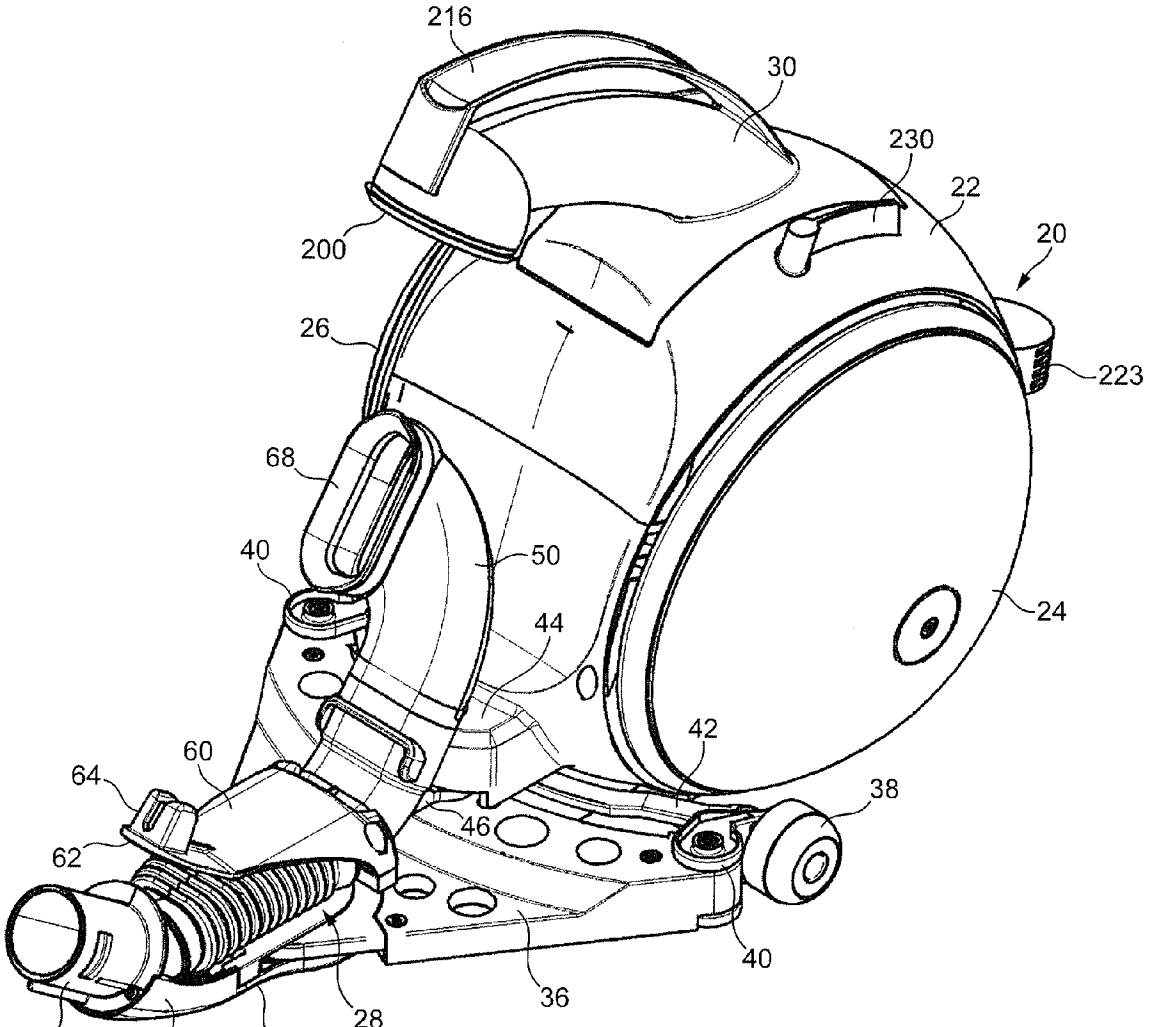
FIG. 3 is a front perspective view, from above, of the vacuum cleaner, with a separating apparatus of the vacuum cleaner removed.

The movement of the track control arm 42 relative to the chassis 32 is effected by movement of the inlet duct 28 relative to the chassis 32. With reference also to FIG. 3, the track control arm 42 passes beneath a duct support 44 extending forwardly from, and preferably integral with, the body 22 of the rolling assembly 20. Alternatively, the duct support 44 may be connected to the chassis 32. The inlet duct 28 is pivotably connected to the duct support 44 for movement about an axis which is substantially orthogonal to the axes of rotation of the wheel assemblies 38. The inlet duct 28 comprises a rearwardly extending arm 46 which passes beneath the duct support 44 to engage the track control arm 42 so that the track control arm 42 moves relative to the chassis 32 as the arm 46 moves with the inlet duct 28.

The inlet duct 28 comprises a relatively rigid inlet section 48, a relatively rigid outlet section 50 and a relatively flexible hose 52 extending between the inlet section 48 and the outlet section 50. The inlet section 48 comprises a coupling 54 for connection to a wand and hose assembly (not shown) for conveying a dirt-bearing air flow to the inlet duct 28. The wand and hose assembly is connected to a cleaner head (not shown) comprising a suction opening through which a dirt-bearing air flow is drawn into the vacuum cleaner 10. The inlet section 48 is connected to, and supported by, a yoke 56. The yoke 56 comprises a floor engaging rolling element 58 for supporting the yoke 56 on the floor surface. The rear section of the yoke 56 is connected to the chassis 32 for pivoting movement about a yoke pivot axis, which is spaced from, and substantially parallel to, the pivot axis of the inlet duct 28. The chassis 32 is shaped to restrict the pivoting movement of the yoke 56 relative to the chassis 32 to within a range of around ±65°.

The outlet section 50 of the inlet duct 28 is pivotably connected to the duct support 44, and extends along the outer surface of the separating apparatus 12. To maneuver the vacuum cleaner 10 over the floor surface, the user pulls the hose of the hose and wand assembly connected to the coupling 54 to drag the vacuum cleaner 10 over the floor surface, which in turn causes the wheels 24, 26 of the rolling assembly 20, the wheel assemblies 38 and the rolling element 58 to rotate and move the vacuum cleaner 10 over the floor surface. To steer the vacuum cleaner 10 to the left, for example, as it is moving across the floor surface, the user pulls the hose of the hose and wand assembly to the left so that the coupling inlet section 48 of the inlet duct 28 and the yoke 56 connected thereto pivot to the left about the yoke pivot axis. This pivoting movement of the inlet section 48 causes the hose 52 to flex and exert a force on the outlet section 50 of the inlet duct 28. This force causes the outlet section 50 to pivot about the duct pivot axis. Due to the flexibility of the hose 52, the amount by which the inlet section 48 pivots about yoke pivot axis is greater than the amount by which the outlet section 50 pivots about the duct pivot axis. For example, when the inlet section 48 is pivoted by an angle of 65° the outlet section 50 is pivoted by an angle of around 20°. As the outlet section 50 pivots about duct pivot axis, the arm 46 moves the track control arm 42 relative to the chassis 32. The movement of the track control arm 42 causes each steering arm 40 to pivot so that the wheel assemblies 38 turn to the left, thereby changing the direction in which the vacuum cleaner 10 moves over the floor surface.

The inlet duct 28 also comprises a support 60 upon which the separating apparatus 12 is removably mounted. The support 60 is connected to the outlet section 50 of the inlet duct 28 for movement therewith as the outlet section 50 pivots about the duct pivot axis. The support 60 extends forwardly, and generally horizontally, from the outlet section 50 so as to extend over the hose 52 of the inlet duct 28. The support 60 is formed from a relatively rigid material, preferably a plastics material, so that the support 60 does not crush the hose 52 when the separating apparatus 12 is mounted on the support 60. The support 60 comprises an inclined front section 62 bearing a spigot 64 which extends upwardly therefrom for location within a recess 66 (shown in FIG. 4) formed in the base 18 of the outer bin 14. When the separating apparatus 12 is mounted on the support 60, the longitudinal axis of the outer bin 14 is inclined to the duct pivot axis, in this example by an angle in the range from 30 to 40°. Consequently, pivoting movement of the inlet duct 28 about the duct pivot axis as the vacuum cleaner 10 is maneuvered over a floor surface causes the separating apparatus 12 to pivot, or swing, about duct pivot axis, relative to the chassis 32, the rolling assembly 20 and the outlet duct 30.

The outlet section 50 of the inlet duct 48 comprises an air outlet 68 from which a dirt-bearing air flow enters the separating apparatus 12. The separating apparatus 12 is illustrated in FIGS. 4 to 8. The specific overall shape of the separating apparatus 12 can be varied according to the size and type of vacuum cleaner in which the separating apparatus 12 is to be used. For example, the overall length of the separating apparatus 12 can be increased or decreased with respect to the diameter of the apparatus, or the shape of the base 18 can be altered.

As mentioned above, the separating apparatus 12 comprises an outer bin 14 which has an outer wall 16 which is substantially cylindrical in shape. The lower end of the outer bin 14 is closed by a curved base 18 which is pivotably attached to the outer wall 16 by means of a pivot 70 and held in a closed position by a catch 72 which engages a groove located on the outer wall 16. In the closed position, the base 18 is sealed against the lower end of the outer wall 16. The catch 72 is resiliently deformable so that, in the event that downward pressure is applied to the uppermost portion of the catch 72, the catch 72 will move away from the groove and become disengaged therefrom. In this event, the base 18 will drop away from the outer wall 16.

Figure 4:
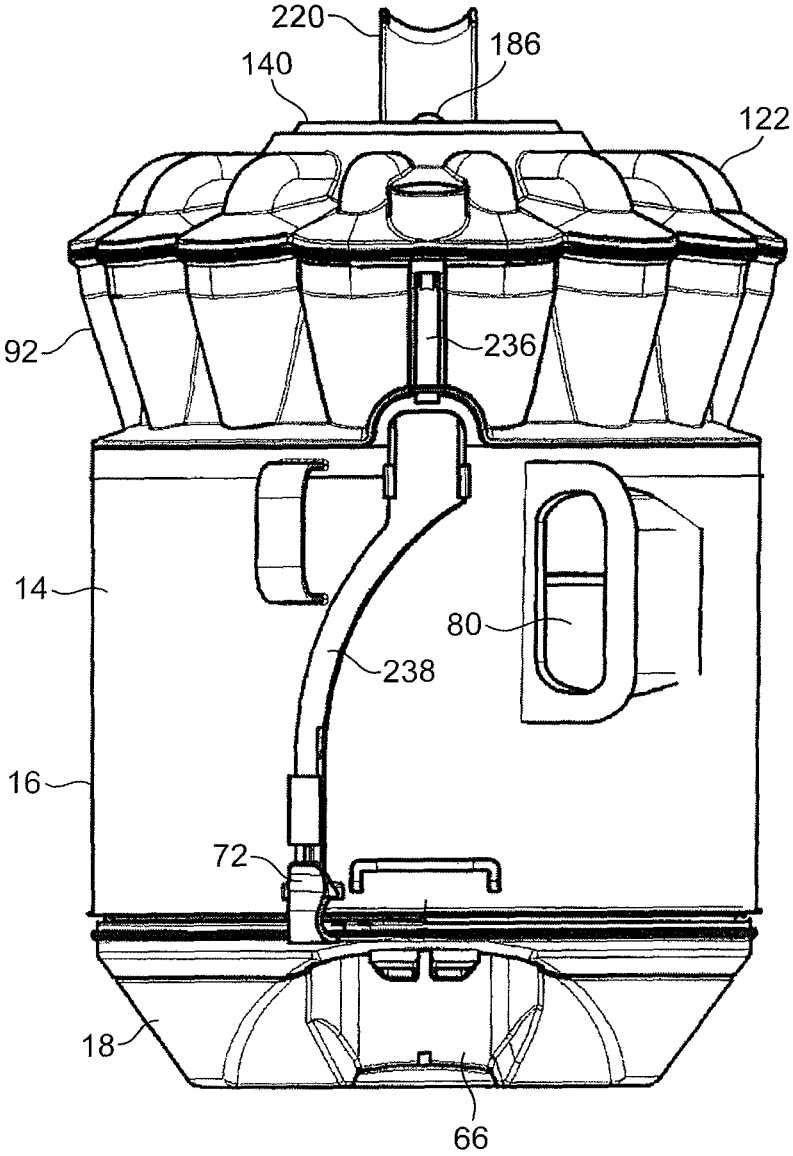
FIG. 4 is a rear view of the separating apparatus.
Figure 6A:
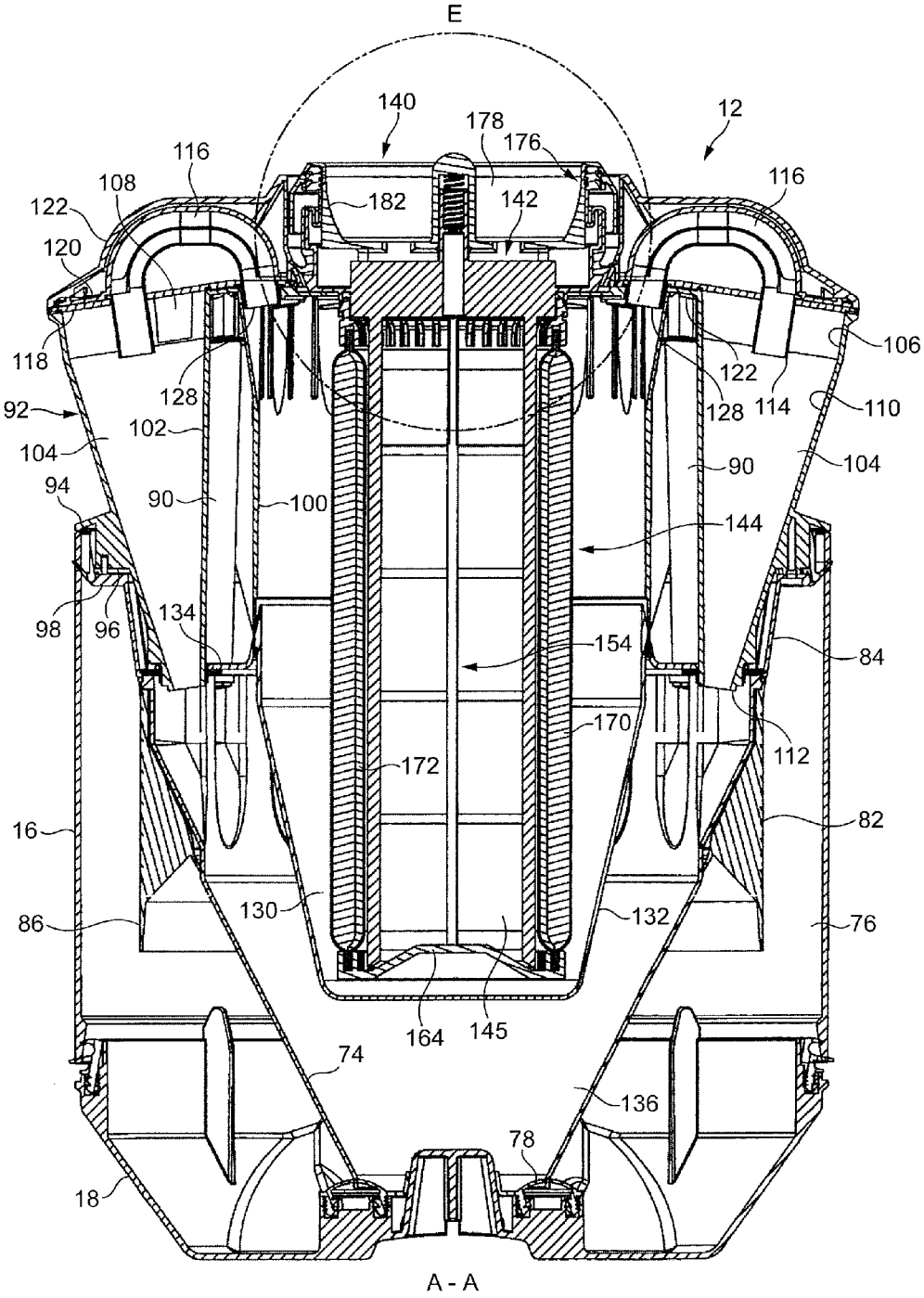
FIG. 6(*a*) is a side sectional view taken along line A-A in FIG. 5, and FIG. 6(*b*) is a close-up of region E identified in FIG. 6(*a*)
Figure 6B:
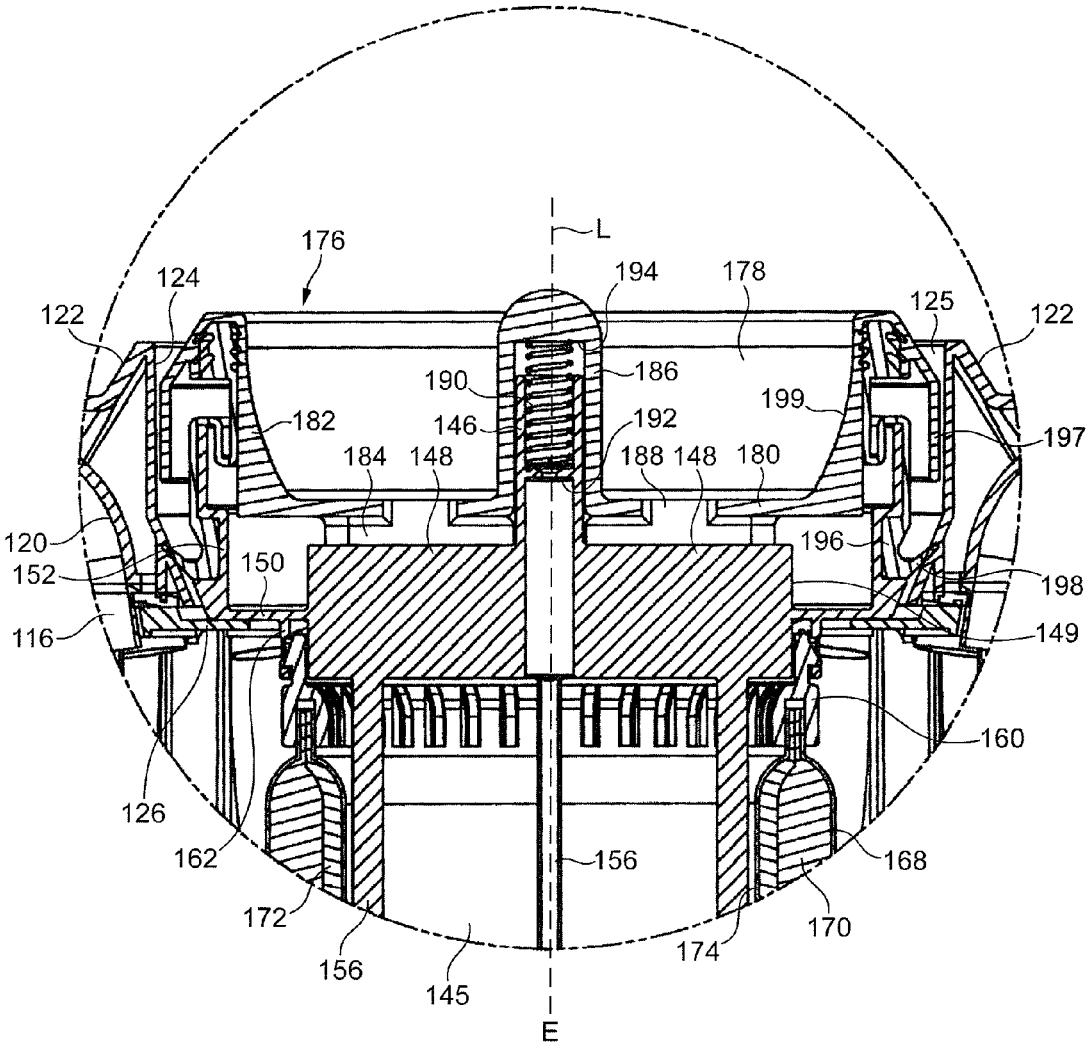

With particular reference to FIG. 6(*a*), the separating apparatus 12 further comprises a generally frusto-conical dust collector 74. The dust collector 74 is located radially inwardly of the outer wall 16 and spaced therefrom so as to form an annular chamber 76 therebetween. The dust collector 74 meets the base 18 (when the base 18 is in the closed position)

and is sealed against an annular sealing member 78 carried by the base 18. A dirty air inlet 80 is provided at the upper end of the outer bin 14 for receiving an air flow from the outlet 68 of the inlet duct 28. The dirty air inlet 80 is located over the outlet 68 when the separating apparatus 12 is mounted on the support 74. The dirty air inlet 80 is arranged tangentially to the outer bin 14 (as shown in FIG. 4) so as to ensure that incoming dirty air is forced to follow a helical path around the annular chamber 76.

A fluid outlet from the annular chamber 76 is provided in the form of a perforated shroud 82. The upper end of the shroud 82 is connected to an upper section 84 of the dust collector 74, which seals against the outer wall 16. A skirt 86 depends from the lower end of the shroud 82. Apertures (not shown) located in the dust collector 74 allow air to pass through the shroud 82 and into a series of passages (not shown) which convey the air flow behind the dust collector 74 and into a plenum chamber 90 defined by a molded cyclone pack 92. The cyclone pack 92 comprises an outwardly flared annular flange 94 which engages the upper end of the outer wall 16, and an annular seat 96 which is connected to a flange 98 located on the upper end of the dust collector 74.

The plenum chamber 90 is located between an annular inner wall 100 of the cyclone pack 92 and the walls 102 of an annular array of cyclones 104 of the cyclone pack 92. The cyclones 104 are arranged in parallel. In the preferred embodiment there are fourteen cyclones 104 arranged in a ring which is centered on a longitudinal axis of the outer bin 14. Each cyclone 104 has an axis which is inclined downwardly and towards the longitudinal axis. The fourteen cyclones 104 can be considered to form a second cyclonic separating unit, with the annular chamber 76 forming the first cyclonic separating unit. In the second cyclonic separating unit, each cyclone 104 has a smaller diameter than the annular chamber 76 and so the second cyclonic separating unit is capable of separating finer dirt and dust particles than the first cyclonic separating unit. It also has the added advantage of being challenged with an air flow which has already been cleaned by the first cyclonic separating unit and so the quantity and average size of entrained particles is smaller than would otherwise have been the case. The separation efficiency of the second cyclonic separating unit is higher than that of the first cyclonic separating unit.

Each cyclone 104 is identical to the other cyclones 104, and comprises a cylindrical upper portion 106 having a tangential inlet 108 which communicates with the plenum chamber 90, and a tapering portion 110 depending from the upper portion 106. The tapering portion 110 of each cyclone 104 is frustoconical in shape and terminates in a cone opening 112 located behind the dust collector 74. A vortex finder 114 is provided at the upper end of each cyclone 104 to allow air to exit the cyclone 104. Each vortex finder 114 communicates with a manifold finger 116 located above the cyclone 104. The vortex finders 114 and a lower section of each manifold finger 116 are located in a vortex finder plate 118 for covering the open upper ends of the cyclones 104. An upper section of each manifold finger 116 is located in an annular web 120 inserted into the vortex finder plate 118. An exhaust manifold 122 is located over the vortex finder plate 118 and the web 120, and provides the upper end of the separating apparatus 12. With reference also to FIG. 6(*b*), the exhaust manifold 122 comprises a central, generally cylindrical wall 124 defining, and extending about, a bore 125.

Each manifold finger 116 is a generally inverted U shape and is bounded by the vortex finder plate 118 and the web 120. Each manifold finger 144 extends from the upper end of a respective cyclone 104 and through a respective one of an annular array of apertures formed in the upper end of the cyclone pack 92. The apertures are located radially inwardly from the cyclones 104 on an annular flange 126 extending radially inwardly from the upper end of the inner wall 100 of the cyclone pack 92 so that air exhausted from the cyclones 104 is conveyed behind the inner wall 100.

The ends 128 of the manifold fingers 116 convey air into a filter housing 130. The filter housing 130 may therefore be considered to comprise a plurality of air inlets. The filter housing 130 comprises an upper housing section defined by the inner wall 100 and the flange 126 of the cone pack 92, and a lower housing section 132 generally in the shape of a truncated cone having an open upper end connected to the upper housing section and a closed lower end. The lower housing section 132 comprises a flange 134 extending radially outwardly from the upper end of the lower housing section 132. The outer edge of the flange 134 is sandwiched between the dust collector 74 and the cone pack 92 during assembly of the separating apparatus 12. The flange 134 comprises an array of apertures into which the cone openings 112 of the cyclones 102 extend. The dust collector 74 and the lower housing section 132 of the filter housing 130 define a dust collection chamber 136 for receiving dust discharged through the cone openings 112 of the cyclones 102.

Figure 7:
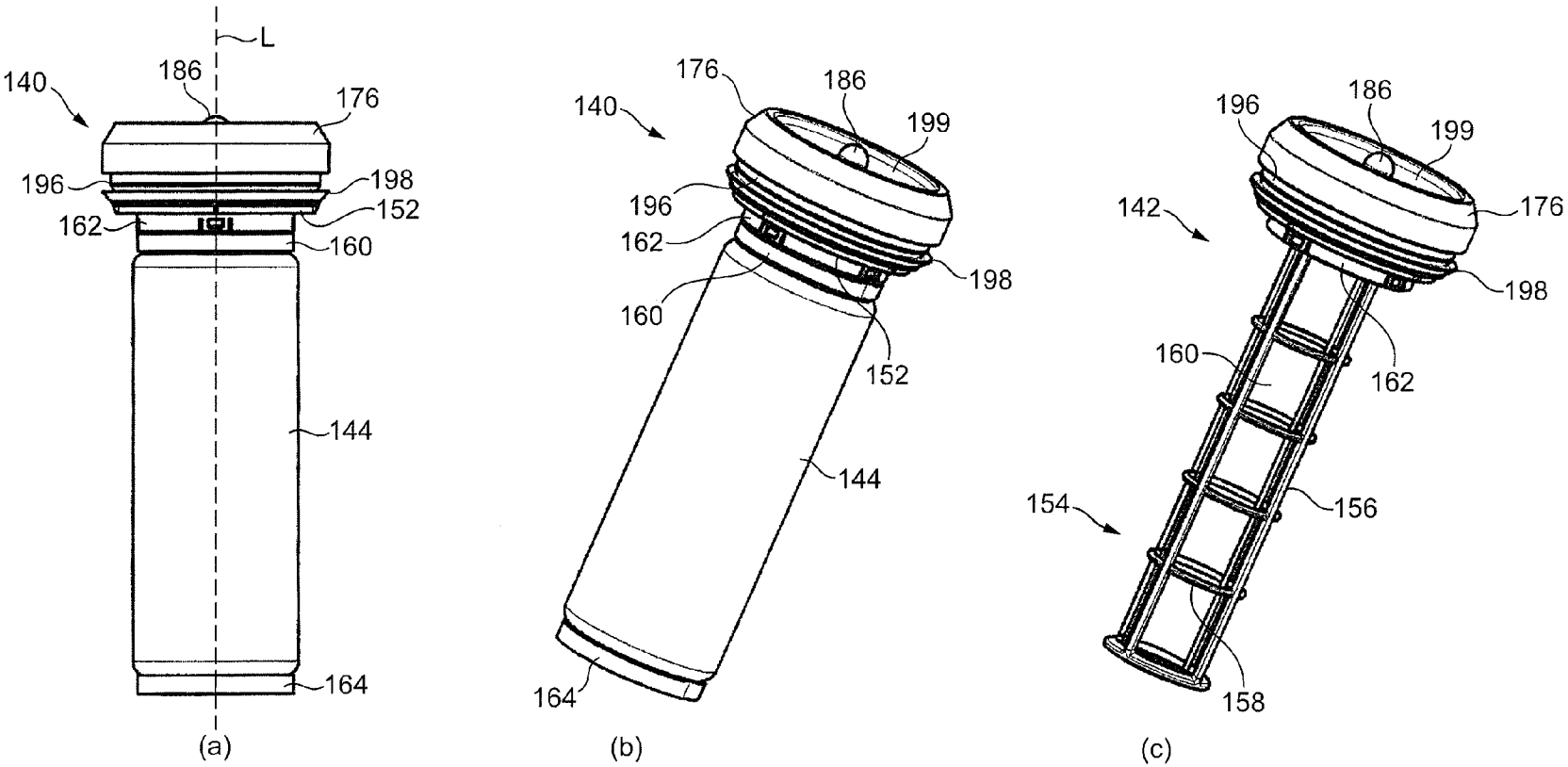
FIG. 7(*a*) is a side view of a filter assembly of the vacuum cleaner, FIG. 7(*b*) is a front perspective view of the filter assembly, and FIG. 7(*c*) is a front perspective view of part of the filter assembly.

A filter assembly 140 is located within the filter housing 130. The filter assembly 140 is inserted into the filter housing 130 through the bore 125 of the exhaust manifold 122. With reference also to FIGS. 7(*a*) to 7(*c*), the filter assembly 140 comprises a body 142 and a filter 144 mounted on the body 142. The filter body 142 is preferably a single-piece item, preferably molded from plastics material, but alternatively the filter body 142 may formed from a plurality of components connected together. The filter body 142 is generally tubular in shape, and comprises a central bore 145. The filter body 142 comprises a central hub 146 located at one end of the filter body 142, and a plurality of spokes 148, in this example four spokes, which extend radially outwardly from the hub 146 to a cylindrical inner wall 149 so as to define a plurality of apertures in the shape of quadrants between adjacent spokes 148. The hub 146 extends along the longitudinal axis L of the filter body 142 (shown in FIGS. 6(*b*) and 7). An annular flange 150 extends radially outwardly from the outer surface of the inner wall 149. A generally cylindrical outer wall 152 extends upwardly from the edge of the flange 150.

A tubular frame 154 depends from the spokes 148 of the filter body 142. The frame 152 extends about the longitudinal axis L. The frame 154 comprises a plurality of axially extending rods 156 each depending from a respective spoke 148, and a plurality of circumferential ribs 158 joining the rods 156 and axially spaced along the frame 154 so as to define a plurality of apertures 160 between the rods 156 and the ribs 158 through which the air flow enters the bore 144 of the filter body 142.

The filter 144 is in the form of a sock filter which extends about the frame 154 of the filter body 142. The upper end of the filter 144 comprises a collar 160, which is retained within an annular groove formed between the inner wall 149 and an annular filter connector 162 depending from the flange 150. The connector 162 has an external diameter which is slightly smaller than the diameter of the inner edge of the flange 126 of the cyclone pack 92. When the filter assembly 140 is located in the filter housing 130, the connector 162 passes through the bore of the flange 126 so that the flange 150 of the filter body 142 is supported by the flange 126 of the cyclone pack 92, which thus provides a seat for the filter housing 130. The lower end of the filter 144 comprises a base or end cap 164 for closing the lower end of the sleeve. The collar 162 and the base 164 are preferably formed from polyurethane.

The filter 144 further comprises a plurality of tubular filter members for removing dust and other particulates from the air flow passing through the filter housing 130. Each filter member of the filter assembly 140 is manufactured with a rectangular shape. The four filter members are then joined and secured together along their longest edge by stitching, gluing or other suitable technique so as to form a tubular length of filter material having a substantially open cylindrical shape. An upper end of each cylindrical filter member is then bonded to the collar 162, while a lower end of each filter member is bonded to the end cap, preferably by over-molding the polyurethane material of the collar 162 and base 164 during manufacture of the filter assembly 140. Alternative manufacturing techniques for attaching the filter members include gluing, and spin-casting polyurethane around the upper and lower ends of the filter members. In this way the filter members are encapsulated by polyurethane during the manufacturing process to produce a strengthened arrangement capable of withstanding manipulation and handling by a user, particularly during washing of the filter assembly 140.

The first, outermost filter member 168 comprises a layer of scrim or web material having an open weave or mesh structure. A second filter member 170 is surrounded by the first filter member 168, and is formed from a non-woven filter medium such as fleece. A third filter member 172 is surrounded by the second filter member 170, and comprises an electrostatic filter medium covered on both sides by a protective fabric. A fourth, innermost filter member 174 is surrounded by the third filter member 168, and comprises a layer of scrim or web material having an open weave or mesh structure. The filter members are thus arranged such that an air flow will impinge first on the first filter member, before impinging, in turn, on the second, third and fourth filter members.

Figure 5:
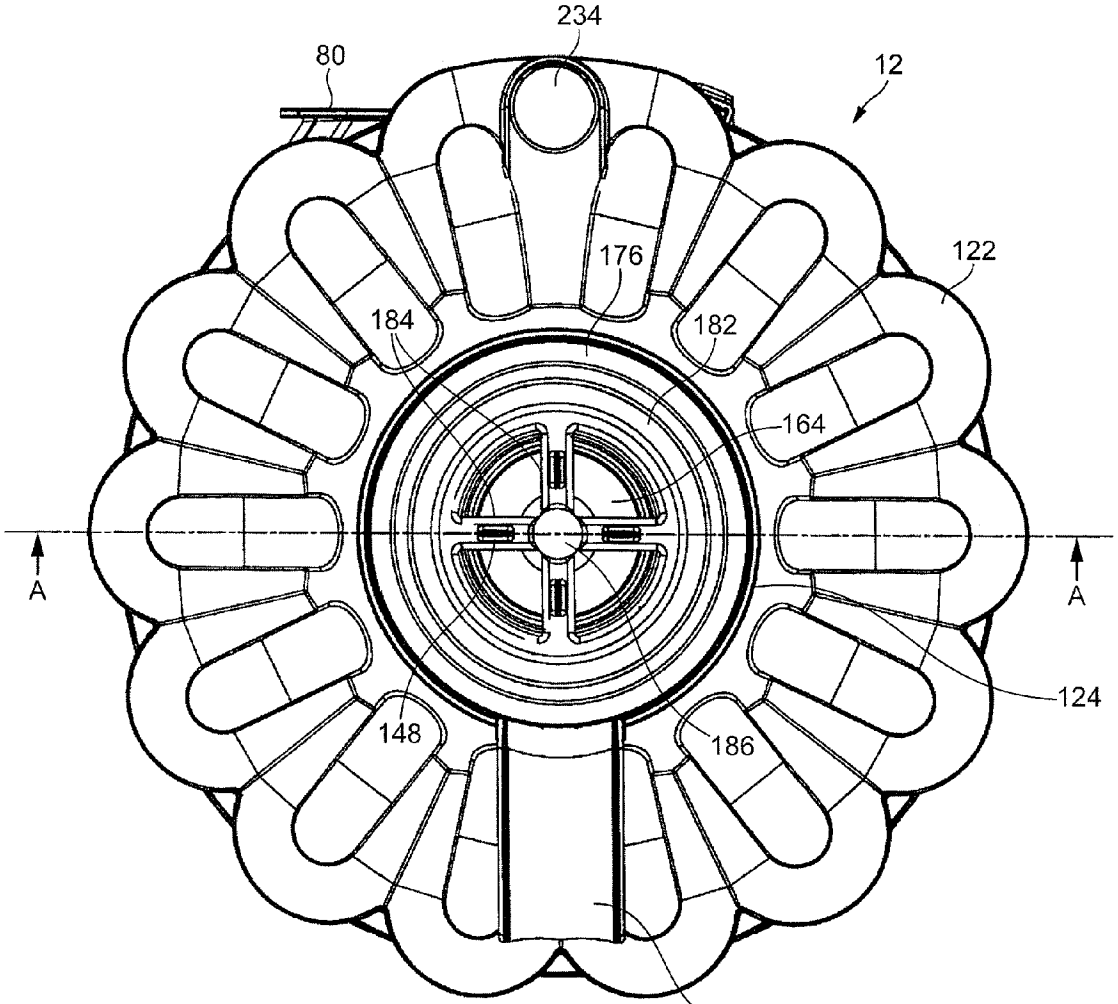
FIG. 5 is a top view of the separating apparatus.

The filter assembly 140 also comprises a coupling member 176 for coupling the filter assembly 140 to the outlet duct 30 of the vacuum cleaner 10. The coupling member 176 comprises an air outlet 178 through which the air flow is exhausted from the filter assembly 140. The coupling member 176 is substantially co-axial with the filter body 142. With particular reference to FIGS. 5 and 6(*b*), the coupling member 176 is generally cup-shaped, and comprises a base 180 and an inner wall 182 extending upwardly from the edge of the base 180. Similar to the filter body 142, the base 180 comprises a plurality of spokes 184 extending radially outwardly from a central hub 186. The hub 186 of the coupling member 176 also extends along the longitudinal axis L, and surrounds the hub 146 of the filter body 142. The coupling member 176 comprises the same number of spokes 184 as the filter body 142. In this example, each spoke 184 of the coupling member 176 meshes with a respective spoke 148 of the filter body 142; the spokes 148 of the filter body 142 are visible in FIG. 5 through windows 188 formed in the upper surfaces of the spokes 184 of the coupling member 176. The base 180 of the coupling member 176 thus also defines a plurality of apertures in the shape of quadrants between adjacent spokes 184.

The coupling member 176 is moveable relative to the filter body 142. A biasing force is applied to the coupling member 176 which urges the coupling member 176 in a direction extending along the longitudinal axis L and away from the filter 144 to engage the outlet duct 30 of the vacuum cleaner 10. In this example the biasing force is applied by a resilient element 190, preferably a helical spring, located between the filter body 142 and the coupling member 176. The resilient element 190 is located on the longitudinal axis L. In this example the hubs 146, 186 are hollow, and the resilient element 190 is located within the hubs 146, 186. One end of the resilient element 190 engages a spring seat 192 located within the hub 146 of the filter body 142, whereas the other end of the resilient element 190 engages the upper end 194 of the hub 186 of the coupling member 176.

A sealing member 196 forms a seal between the filter body 142 and the coupling member 176. The sealing member 196 is preferably in the form of a convoluted sealing member which extends about the outer wall 152 of the filter body 142 and the inner wall 182 of the coupling member 176, and which maintains the seal between the filter body 142 and the coupling member 176 as the coupling member 176 moves relative to the filter body 142. One end of the sealing member 196 is retained within a circumferential groove formed in the outer wall 152 of the filter body 142, whereas the other end of the sealing member 196 is retained between the inner wall 182 and the outer wall 197 of the coupling member 176. The sealing member 196 comprises an annular sealing element 198 in the form of a lip seal for engaging the wall 124 of the exhaust manifold 122 to prevent air from leaking between the wall 124 of the exhaust manifold 122 and the filter assembly 140 during use of the vacuum cleaner 10.

The inner wall 182 of the filter coupling 176 has a concave, or bowl-shaped, inner surface 199 which engages the outlet duct 30 of the vacuum cleaner 10. With reference to FIGS. 2(*b*), 9(*a*) and 9(*b*), the outlet duct 30 comprises an annular sealing member 200 connected to an air inlet 202 of the outlet duct 30 for engaging the concave inner surface 199 of the filter coupling 176 continuously about the longitudinal axis L. The air inlet 202 of the outlet duct 30 is generally dome-shaped. As described previously, movement of the outlet section 50 of the inlet duct 28 about the duct pivot axis during a cleaning operation causes the separating apparatus 12 to swing about the duct pivot axis relative to the outlet duct 30. The continuous engagement between the inner surface 199 of the coupling member 176 and the sealing member 200 of the outlet duct 30, coupled with the bias of the coupling member 176 towards the outlet duct 30, enables a continuous air tight connection to be maintained between the filter assembly 140 and the outlet duct 30 as the separating apparatus 12 moves relative to the outlet duct 30 during movement of the vacuum cleaner 10 across a floor surface.

The outlet duct 30 is generally in the form of a curved arm extending between the separating apparatus 12 and the rolling assembly 20. An elongated tube 204 provides a passage 206 for conveying air from the air inlet 202 to the rolling assembly 20.

The outlet duct 30 is moveable relative to the separating apparatus 12 to allow the separating apparatus 12 to be removed from the vacuum cleaner 10, and to allow the filter assembly 140 to be removed from the filter housing 130 of the separating apparatus 12. The end of the tube 204 remote from the air inlet 202 of the outlet duct 30 is pivotably connected to the main body 22 of the rolling assembly 20 to enable the outlet duct 30 to be moved between a lowered position, shown in FIG. 2(*a*), in which the outlet duct 30 is in fluid communication with the separating apparatus 12, and a raised position, shown in FIG. 2(*b*), which allows the separating apparatus 12 to be removed from the vacuum cleaner 10.

Figure 9A:
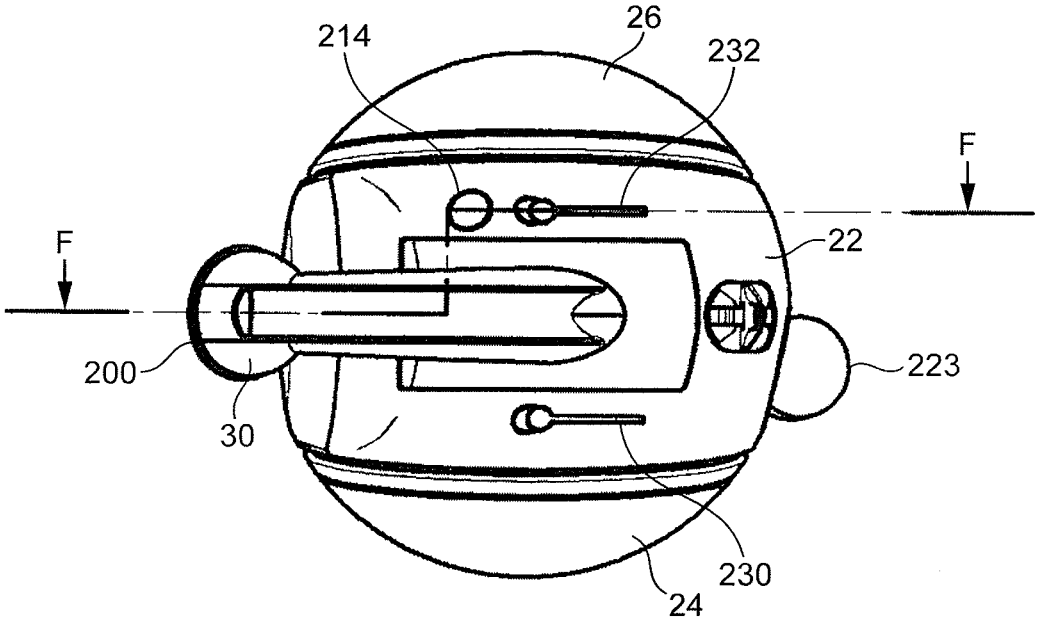
FIG. 9(*a*) is a top view of the rolling assembly, and FIG. 9(*b*) is a side sectional view taken along line F-F in FIG. 9(*a*).
Figure 9B:
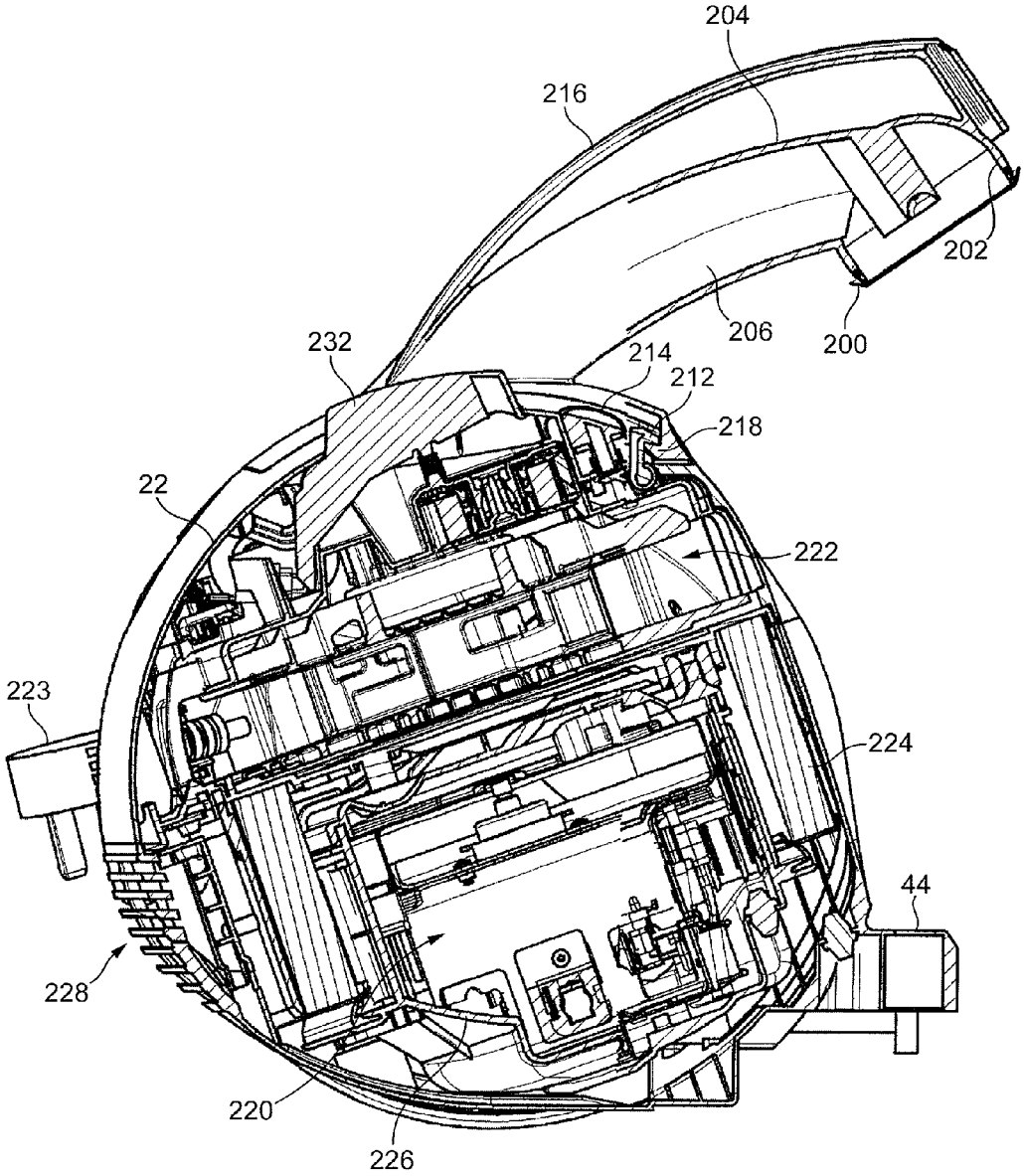

With reference to FIG. 9(*b*), the outlet duct 30 is biased towards the raised position by a torsion spring (not shown) located in the main body 22. The main body 22 also comprises a biased catch 212 for retaining the outlet duct 30 in the lowered position against the force of the torsion spring, and a catch release button 214. The outlet duct 30 comprises a handle 216 to allow the vacuum cleaner 10 to be carried by the user when the outlet duct 30 is retained in its lowered position. The catch 212 is arranged to co-operate with a finger 218 connected to outlet duct 30 to retain the outlet duct in its lowered position. Depression of the catch release button 214 causes the catch 212 to move away from the finger 218, against the biasing force applied to the catch 212, allowing the torsion spring to move the outlet duct 30 to its raised position.

The rolling assembly 20 will now be described with reference to FIGS. 9(*a*) and 9(*b*). As mentioned above, the rolling assembly 20 comprises a main body 22 and two curved wheels 24, 26 rotatably connected to the main body 22 for engaging a floor surface. In this embodiment the main body 22 and the wheels 24, 26 define a substantially spherical rolling assembly 20. The rotational axes of the wheels 24, 26 are inclined upwardly towards the main body 22 with respect to a floor surface upon which the vacuum cleaner 10 is located so that the rims of the wheels 24, 26 engage the floor surface. The angle of the inclination of the rotational axes of the wheels 24, 26 is preferably in the range from 4 to 15°, more preferably in the range from 5 to 10°, and in this embodiment is around 6°. Each of the wheels 24, 26 of the rolling assembly 20 is dome-shaped, and has an outer surface of substantially spherical curvature, so that each wheel 24, 26 is generally hemispherical in shape.

The rolling assembly 20 houses a motor-driven fan unit 220, a cable rewind assembly 222 for retracting and storing within the main body 22 a portion of an electrical cable (not shown) terminating in a plug 223 providing electrical power to, inter alia, the motor of the fan unit 220, and a filter 224. The fan unit 220 comprises a motor, and an impeller driven by the motor to drawn the dirt-bearing air flow into and through the vacuum cleaner 10. The fan unit 220 is housed in a motor bucket 226. The motor bucket 226 is connected to the main body 22 so that the fan unit 220 does not rotate as the vacuum cleaner 10 is maneuvered over a floor surface. The filter 224 is located downstream of the fan unit 220. The filter 224 is tubular and located around a part of the motor bucket 226.

The main body 22 further comprises an air exhaust port for exhausting cleaned air from the vacuum cleaner 10. The exhaust port is formed towards the rear of the main body 22. In the preferred embodiment the exhaust port comprises a number of outlet holes 228 located in a lower portion of the main body 22, and which are located so as to present minimum environmental turbulence outside of the vacuum cleaner 10.

A first user-operable switch 230 is provided on the main body and is arranged so that, when it is depressed, the fan unit 220 is energized. The fan unit 220 may also be de-energized by depressing this first switch 230. A second user-operable switch 232 is provided adjacent the first switch 230. The second switch 232 enables a user to activate the cable rewind assembly 22. Circuitry for driving the fan unit 220 and cable rewind assembly 222 is also housed within the rolling assembly 20.

In use, the fan unit 220 is activated by the user and a dirt-bearing air flow is drawn into the vacuum cleaner 10 through the suction opening in the cleaner head. The dirt-bearing air passes through the hose and wand assembly, and enters the inlet duct 28. The dirt-bearing air passes through the inlet duct 28 and enters the dirty air inlet 80 of the separating apparatus 12. Due to the tangential arrangement of the dirty air inlet 80, the air flow follows a helical path relative to the outer wall 16. Larger dirt and dust particles are deposited by cyclonic action in the chamber 76 and collected therein.

The partially-cleaned air flow exits the annular chamber 76 via the perforations in the shroud 82 and enters the plenum chamber 90. From the plenum chamber 90, the air flow enters the cyclones 104 wherein further cyclonic separation removes some of the dirt and dust still entrained within the air flow. This dirt and dust is deposited in the chamber 136 while the cleaned air exits the cyclones 104 via the vortex finders 114 and enters the manifold fingers 116. The air flow then passes into the filter housing 130 from the ends 128 of the manifold fingers 116. Within the filter housing 130, the air flow enters the filter assembly 140 through the filter 144. The air flow passes sequentially through the first to fourth layers of the filter 144 and enters the bore 145 of the filter body 142 through the apertures 160 in the frame 154. The frame 154 thus serves to prevent the filter 144 from collapsing as the air flow passes through the filter 144 towards the longitudinal axis L. The air flow subsequently passes axially along the bore 145 of the filter body 142, and between the spokes 148, 178 of the filter body 142 and the coupling member 176 to be exhausted through the air outlet 178 of the coupling member 176 and into the dome-shaped air inlet 202 of the outlet duct 30.

The air flow passes along the passage 206 within the outlet duct 30, and enters the main body 22 of the rolling assembly 20. Within the rolling assembly 20, the air flow is guided into the fan unit 200. The air flow subsequently passes out of the motor bucket 226, for example through apertures formed in the side wall of the motor bucket 226, and passes through the filter 224. Finally the air flow is exhausted through the outlet holes 228 in the main body 22.

When the outlet duct 30 is in its raised position, the separating apparatus 12 may be removed from the vacuum cleaner 10 for emptying and cleaning. The separating apparatus 12 comprises a handle 220 for facilitating the removal of the separating apparatus 12 from the vacuum cleaner 10. The handle 220 is connected to the exhaust manifold 122, for example by a snap-fit connection. To empty the separating apparatus 12, the user depresses a button 234 located on the upper surface of the exhaust manifold 122 for actuating a mechanism for applying a downward pressure to the uppermost portion of the catch 72 to cause the catch 72 deform and disengage from the groove located on the outer wall 16 of the outer bin 14. This enables the base 18 to move away from the outer wall 16 to allow dirt and dust that has been collected in the separating apparatus 12 to be emptied into a dustbin or other receptacle. As shown in FIG. 4, the actuating mechanism comprises an upper push rod 236 which is slidably located on the outer surface of the cyclone pack 92, and which is pushed against a lower push rod 238 slidably located on the outer wall 16 of the outer bin 14. This in turn causes the lower push rod 238 to urge the catch 72 away from the groove, allowing the base 18 to drop away from the outer wall 16 so that dirt and dust collected within the separating apparatus 12 can be removed.

Figure 8:
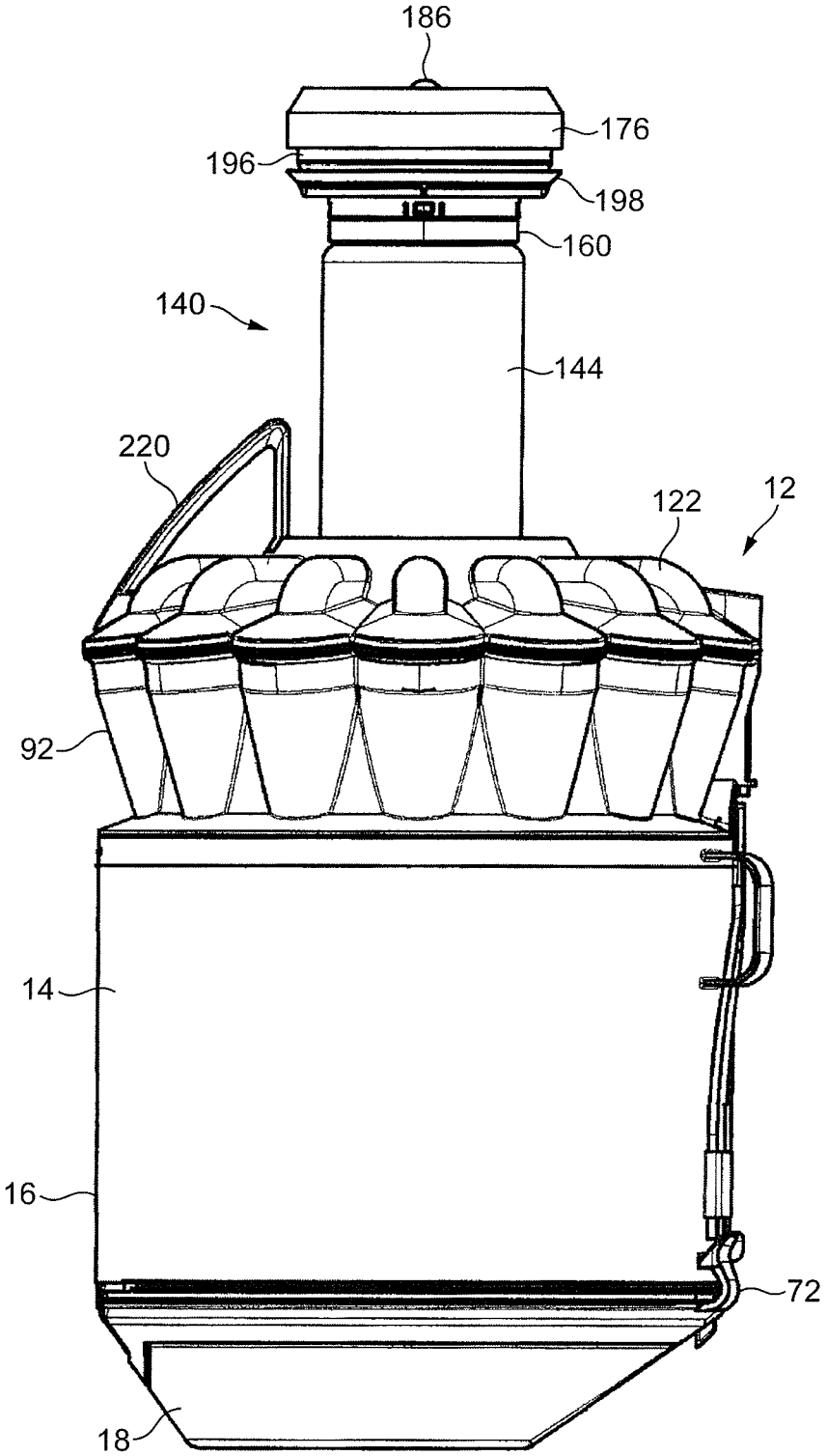
FIG. 8 is a side view of the separating apparatus with the filter assembly partially removed from a filter housing of the filter assembly.

To remove the filter assembly 140 from the filter housing 130, the user grips the hub 186 and pulls the filter assembly 140 from the filter housing 130; FIG. 8 illustrates the filter assembly 140 partially removed from the filter housing 130. When the filter assembly 140 has been removed fully from the filter housing 130, the user may clean or wash the filter assembly 140, and return the filter assembly 140 to the filter housing 130.

The invention claimed is:

1. A filter assembly for a vacuum cleaning appliance, the filter assembly comprising:

a filter body;

a filter mounted on the filter body;

a biased coupling member moveable relative to the filter body for coupling the filter assembly to a duct of the vacuum cleaning appliance for receiving an air flow exhausted from the filter assembly, the coupling member comprising an air outlet through which the air flow is exhausted from the filter assembly to an inlet of the duct for receiving the air flow exhausted from the filter assembly; and a sealing member for forming a seal between the filter body and the coupling member.

2. The filter assembly of claim 1, wherein the sealing member is in the form of a convoluted sealing member.

3. The filter assembly of claim 1, wherein the sealing member comprises an annular sealing element for engaging a filter housing of the vacuum cleaning appliance.

4. The filter assembly of claim 1, wherein the coupling member comprises a concave surface for engaging the duct of the vacuum cleaning appliance.

5. The filter assembly of claim 1, comprising a resilient element located between the filter body and the coupling member for urging the coupling member away from the filter body.

6. The filter assembly of claim 5, wherein each of the filter body and the coupling member comprises a central hub, and the resilient element is located between the hubs to urge the coupling member away from the filter body.

7. The filter assembly of claim 6, wherein the air outlet extends about the hub of the coupling member.

8. The filter assembly of claim 1, wherein the filter body comprises a frame, and wherein the filter extends about the frame.

9. The filter assembly of claim 8, wherein the filter is in the form of a sleeve extending about the frame of the filter body.

10. The filter assembly of claim 8, wherein the filter is connected at one end thereof to the filter body.

11. The filter assembly of claim 10, comprising an end cap for closing the other end of the filter.

12. A vacuum cleaning appliance comprising:

a filter housing having at least one air inlet for receiving an air flow;

a filter assembly removably locatable within the filter housing for removing dirt from the air flow; and a duct having an inlet for receiving the air flow exhausted from the filter assembly;

wherein the filter assembly comprises a filter body, a filter mounted on the filter body, a biased coupling member moveable relative to the filter body for engaging the duct, the coupling member comprising an air outlet through which the air flow is exhausted from the filter assembly to the inlet of the duct, and a sealing member for forming a seal between the filter body and the coupling member.

13. The vacuum cleaning appliance of claim 12, wherein the filter housing comprises an annular seat for supporting the filter body of the filter assembly.

14. The vacuum cleaning appliance of claim 12, wherein the duct is moveable relative to the housing to allow the filter assembly to be removed from the filter housing.

15. The vacuum cleaning appliance of claim 12, comprising cyclonic separating apparatus for separating dirt from the air flow upstream of the filter assembly, and wherein the filter housing is located in the separating apparatus.

16. The vacuum cleaning appliance of claim 15, wherein the separating apparatus comprises a plurality of cyclones, and wherein the filter housing comprises a plurality of inlets each for receiving a portion of the air flow from a respective one of the cyclones.

17. The vacuum cleaning appliance of claim 16, wherein the cyclones surround the filter housing.

18. The vacuum cleaning appliance of claim 15, wherein the filter housing comprises an opening located in an upper surface of the separating apparatus for receiving the filter assembly.

19. The vacuum cleaning appliance of claim 15, wherein the duct is moveable relative to the separating apparatus to allow the separating apparatus to be removed from the appliance.

20. The vacuum cleaning appliance of claim 12, wherein the sealing member is in the form of a convoluted sealing member.

21. The vacuum cleaning appliance of claim 12, wherein the sealing member comprises an annular sealing element for engaging a filter housing of the vacuum cleaning appliance.

22. The vacuum cleaning appliance of claim 12, wherein the coupling member comprises a concave surface for engaging the duct of the vacuum cleaning appliance.

23. The vacuum cleaning appliance of claim 12, comprising a resilient element located between the filter body and the coupling member for urging the coupling member away from the filter body.

24. The vacuum cleaning appliance of claim 23, wherein each of the filter body and the coupling member comprises a central hub, and the resilient element is located between the hubs to urge the coupling member away from the filter body.

25. The vacuum cleaning appliance of claim 24, wherein the air outlet extends about the hub of the coupling member.

26. The vacuum cleaning appliance of claim 12, wherein the filter body comprises a frame, and wherein the filter extends about the frame.

27. The vacuum cleaning appliance of claim 26, wherein the filter is in the form of a sleeve extending about the frame of the filter body.

28. The vacuum cleaning appliance of claim 26, wherein the filter is connected at one end thereof to the filter body.

29. The vacuum cleaning appliance of claim 28, comprising an end cap for closing the other end of the filter.

* * * * *